United States Patent [19]

Guimond et al.

[11] 4,122,978

[45] Oct. 31, 1978

[54] PRESSURIZED PACKAGE FOR DISPENSING A PRODUCT IN A FINELY DISPERSED SPRAY PATTERN WITH LITTLE DILUTION BY PROPELLANT

[75] Inventors: Ronald N. Guimond, Stoughton; Harold R. Thompson, Duxbury, both of Mass.

[73] Assignee: The Gillette Company, Boston, Mass.

[21] Appl. No.: 729,997

[22] Filed: Oct. 6, 1976

Related U.S. Application Data

[63] Continuation of Ser. No. 587,834, Jun. 18, 1975, abandoned, which is a continuation-in-part of Ser. No. 492,701, Jul. 29, 1974, abandoned.

[51] Int. Cl.[2] ..... B65D 83/14; B67D 5/58

[52] U.S. Cl. ..... 222/189; 210/468; 222/402.1; 239/575; 239/590.3

[58] Field of Search ..... 222/189, 394, 402.1; 239/575, 590, 590.3; 137/550; 210/466, 467, 468

[56] References Cited

U.S. PATENT DOCUMENTS

| | | | |
|---|---|---|---|
| 2,594,539 | 4/1952 | Brown | 239/575 X |
| 2,815,889 | 12/1957 | Stetz | 222/189 |
| 3,098,589 | 7/1963 | Graham | 222/189 X |
| 3,209,954 | 10/1965 | Webster | 222/189 |
| 3,647,411 | 3/1972 | Stevens | 222/402.1 X |
| 3,756,472 | 9/1973 | Vos | 222/189 |

*Primary Examiner*—Robert B. Reeves
*Assistant Examiner*—Francis J. Bartuska

[57] ABSTRACT

A pressurized dispensing package includes a container in which the product to be dispensed and a gaseous propellant are stored. The product is dispensed through a discharge passage that extends from a control valve to a terminal orifice. A plural passage flow control member is disposed in the discharge passage. Each passage of the flow control member has a flow dimension in the range of one to one hundred microns and the length of the flow control member several times the passage flow dimension so that a significant pressure drop occurs across the flow control member as the product flows through the member. The total flow area of the flow control passages disposed in the discharge passage is greater than the area of the terminal orifice but less than fifty percent of the area of the discharge passage in which the flow control member is located. The flow control member provides an intermediate pressure drop and a change in product flow configuration downstream from the flow control member and the product is emitted from the terminal orifice in a desirable spray pattern without requiring the dilution and aerosol effect created by the dispensing of substantial amounts of propellant with the product.

26 Claims, 4 Drawing Figures

PRESSURIZED PACKAGE FOR DISPENSING A PRODUCT IN A FINELY DISPERSED SPRAY PATTERN WITH LITTLE DILUTION BY PROPELLANT

This application is a continuation of U.S. application Ser. No. 587,834, filed June 18, 1975 now abandoned, entitled PRESSURIZED PACKAGE FOR DISPENSING A PRODUCT IN A FINELY DISPERSED SPRAY PATTERN WITH LITTLE DILUTION BY PROPELLANT, which in turn is a continuation-in-part of U.S. application Ser. No. 492,701, filed July 29, 1974 now abandoned, entitled PRESSURIZED DISPENSING PACKAGE.

SUMMARY OF INVENTION

This invention relates to dispensing packages, and more particularly to pressurized dispensing packages for delivering a liquid product in a spray pattern.

Aerosol dispensers which deliver their contents in a spray pattern are well known, and have been used in connection with a large number of products. According to the aerosol principle, the product is dispensed with a substantial amount of a pressurized gas propellant, such as a fluorocarbon, as by means of a vapor tap. The gaseous propellant expands rapidly when the mixture of product and propellant is discharged into the atmosphere and contributes to the product breakup and the formation of a desired spray pattern of minute particles.

While aerosol dispensers produce a desirable spray pattern for many products, such as deodorants and hairsprays, the gaseous propellant delivered with the product is necessarily discharged into the atmosphere in relatively large quantities. An alternate dispensing method which does not require the dispensing of large quantities of propellant uses a pressurized propellant, for example a gaseous propellant that is at least partially soluble in the product or a gaseous propellant that acts on a compressible container in which the product is stored. When the valve is actuated, the propellant pressure forces the product out through a discharge orifice. As the product is dispensed, the pressurized propellant expands and maintains adequate dispensing pressure in the container. The discharge consists of relatively high purity product with little or no dilution by the propellant. It has been difficult to achieve a satisfactory spray pattern of finely dispersed particles with this type of dispensing system, however, since little propellant at most is available for expansion outside the container. A pressurized dispensing system of conventional aerosol configuration arranged to dispense a liquid product with only a small quantity of propellant does not reliably produce the desired uniform spray of finely dispersed particles.

In view of the above considerations, it is an object of the present invention to provide a novel and improved pressurized dispensing package.

Another object is the provision of a novel and improved dispensing package utilizing a soluble gaseous propellant to dispense a liquid product in a spray pattern.

A further object is the provision of a novel and improved pressurized dispensing package that reliably achieves a fine spray pattern of finely dispersed particles of a liquid product.

In the accomplishment of these and other objects, the present invention provides a dispensing package that includes a pressurized container having therein a liquid product to be dispensed and a gaseous propellant. A valve controls the flow of product from the container through a discharge passage that terminates in a terminal or discharge orifice. In preferred embodiments, the terminal orifice has a diameter in the range of 0.1 to 0.4 millimeter. A flow control member that has plural elongated flow control passages is disposed in the discharge passage between the control valve and the terminal orifice. The effective flow dimension (width) of each flow control passage is in the range of 1 to 100 microns, that dimension preferably being in the range of 10 to 50 microns, while the total effective flow area of the flow control passage apertures disposed in the discharge passage is greater than the area of the terminal orifice but less than 50 percent of the area of the discharge passage in which the flow control member is located. The length of the flow control member is substantially greater (e.g. preferably at least 10 times) than the average flow dimension of the passages in the flow control member and the effective flow length of each of the passages is preferably at least twice the lateral width of the discharge passage immediately downstream from the flow control member. The product in traversing the discharge passage in dispensing action undergoes a substantial pressure drop across the flow control member and a change in product flow configuration and is dispensed in a desirable spray pattern of minute particles.

In particular embodiments the valve includes a fixed sealing member and a movable valve member, spring means normally urging the valve member against the fixed member to close the valve passageway, and a valve stem that extends outwardly of the container, the stem including a longitudinal bore about 1.5 millimeters in diameter. An actuator button is fitted over the upper portion of the valve stem, and defines a terminal orifice of about 0.2 millimeter diameter and a passageway between the terminal orifice and the stem bore. In one embodiment a flow control member of about 6 millimeters in length is secured in the valve stem, and has a multiplicity of passages that extend the length of the member with over 500 discrete passage apertures. The passages in that particular embodiment are interconnected (although in other embodiments an arrangement of discrete separate passages may be employed) and have an average diameter of less than about 0.04 millimeter. In another embodiment the flow control member is secured in the actuator button. In particular embodiments a filter screen may be advantageously utilized in the discharge passage upstream of the flow control member. Preferably the flow control member has the effect of reducing the product flow rate through the discharge passage at least ten percent. When the actuator button is pressed, it moves the valve stem, thereby opening the valve passageway. The product as it is dispensed undergoes a pressure drop as it passes through the multiple minute elongated flow passages of the flow control member in the discharge passage. The resulting discharge is in a commercially satisfactory dispersed spray of minute particles similar to the aerosol spray but without the need for substantial amounts of propellant to be dispensed with the product.

Systems in accordance with the invention have reduced output flow rates, with the advantage that the output carries a considerably higher proportion of product (at least about 90%) than does the output from a typical aerosol system (which output contains only about 40% product) while distributing that dispensed product in a desired finely divided and repeatable spray pattern. While the reasons are not entirely clear, the invention provides spray pattern characteristics superior to the spray pattern characteristics of a similar type dispensing system with a flow restriction such as a filter screen or other filtering member or with a similar type of flow control member positioned between the control valve and the product in the container. It is believed that these superior characteristics are due in part to the relatively small volume of the discharge passage downstream of the flow control member between that member and the terminal orifice and also the reduced pressure in the discharge passage immediately downstream of the flow control member.

Other objects, features and advantages of the invention will be seen as the following description of particular embodiments progresses in conjunction with the accompanying drawing in which.

DESCRIPTION OF PARTICULAR EMBODIMENTS

Figure 1:
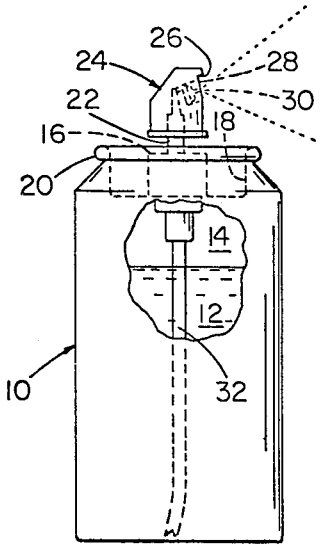
FIG. 1 is a side elevational view with parts broken away of a pressurized dispensing package constructed in accordance with the invention.

Referring to FIG. 1, the dispensing package includes a container 10 which is constructed in conventional manner. The liquid product 12 to be dispensed, a deodorant formulation in ethyl alcohol, for example, is stored at the lower portion of container 10 with a pressurized head 14 of suitable gaseous propellant such as carbon dioxide or nitrous oxide above the liquid product 12. The viscosity of the liquid product may be in the range of 0.5 to 1500 centipoises, a preferable range of viscosity being 1 to 100 centipoises. A typical initial gas pressure is about 85 p.s.i.g. The gaseous propellant is dissolved in the liquid to an extent determined by its pressure and temperature, the amount of dissolved gas being greatest when the container is full and decreasing as product is dispensed.

A valve assembly generally indicated by numeral 16 is secured to valve cup 18 which in turn is secured to bead 20 formed in the top wall of the container. The valve assembly has a tubular valve stem 22 on which is mounted an actuator button 24. A recess 26 formed in a lateral wall of the button houses a plastic plug 28. The plug 28 defines a discharge or terminal orifice 30, the diameter of which is about 0.2 millimeter, through which the product is discharged into the atmosphere from the package. A dip tube 32 extends vertically downward from the valve assembly through the product 12 to the bottom of container 10 and serves as a conduit for guiding product up to the valve 16.

Figure 2:
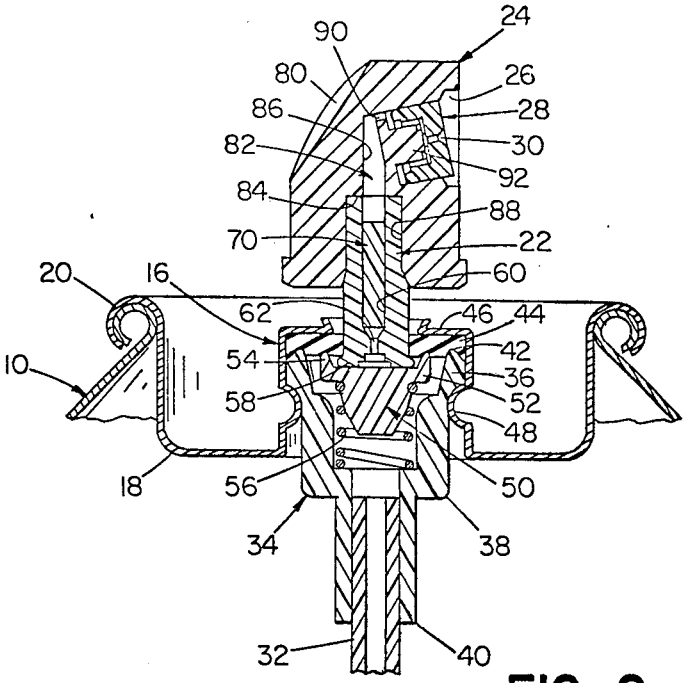
FIG. 2 is an enlarged cross-sectional view of the valve assembly employed in the package shown in FIG. 1.
Figure 3:
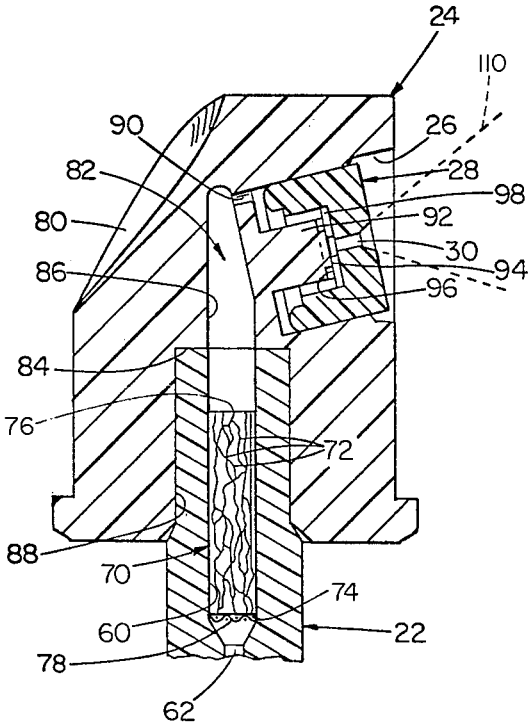
FIG. 3 is a sectional view, on a still larger scale, of portions of the embodiment shown in FIG. 1 showing aspects of the discharge passage downstream from the valve with a diagrammatic representation of the flow control member disposed in the valve stem.

With reference to FIGS. 2 and 3, the valve assembly 16 includes a cup-like housing member 34 which has a flared upper portion 36, an intermediate portion 38 and a lower tubular extension 40 which receives dip tube 32. Seated on the upper annular lip 42 of member 34 is an elastomeric sealing disk 44 that is compressed between lip 42 and the upper wall 46 of valve cup 18, housing 34 being secured to valve cup 18 by indentations 48. A valve member 50 positioned within housing 34 has a cupped upper portion 52, the upper edge 54 of which is normally pressed against the bottom surface of sealing disk 44 by compressed helical spring 56. Downward movement of the valve member 50 away from disk 44 opens the valve assembly. Valve stem 22 has a flanged lower portion 58 that is seated in the cupped portion 52 of valve member 50, and a tubular upwardly extending passage portion 60 that has a diameter of about 1.5 millimeters and a length of about nine millimeters. Formed in the base of passage portion 60 is a valve port 62 about 0.3 millimeter in diameter.

A porous flow control member 70 that is about six millimeters long is frictionally secured in stem passage portion 60. Various materials, such as porous metals and fibrous materials in particular applications, may be used in member 70, provided the selected material has appropriate compatibility with the product to be dispensed. In this particular embodiment member 70 is of a polymeric material such as a high density polyethylene or a fluorocarbon available from Porex Division of Glassrock Products, Inc. and has a passage volume of about 40%. The porous flow control member 70 has a multiplicity of interconnected passages 72 that have average effective flow sizes of about thirty-five microns and that provide multiple flow paths from upstream end 74 to downstream end 76. Tests of this flow control member with ethyl alcohol in a discharge system that include a valve stem and an actuator button 24 showed that the flow control member 70 produced a reduction of flow rate in the range of 20–30%. A 325 mesh stainless steel screen 78 as indicated in FIG. 3 may optionally be inserted in the discharge passage 60 upstream from the flow control member 70. Location of screen 78 in this position produced improved dispensing spray characteristics over the useful dispensing life of the package compared to dispensing systems in which the screen 78 was located downstream of member 70 and systems in which no screen 78 was employed.

Button 24 includes an inclined finger surface 80 adapted to be pushed by the operator to rock the cap forward when dispensing of product is desired. A cavity 82 in cap 24 extends to the bottom of the button, the cavity having an intermediate annular wall or shoulder 84 which provides a transition between the tapered upper end 86 of cavity 82 and the lower cylindrical portion 88. A 0.2 millimeter diameter port 90 at the upper end 86 extends through the cavity wall to recess 26 in which post 92 is centrally disposed. Insert 28 is frictionally secured in recess 26 and has an interior surface 94 seated on the end surface 96 of post 92 and a discharge orifice 30. Grooves and lands in the surfaces of post 92 and plug insert surface 94 define walls of a swirl chamber 98 between orifice 90 and orifice 30 that produces a swirling flow pattern assisting the breakup of the dispensed product into desirable spray form as it is dispensed through orifice 30.

Figure 4:
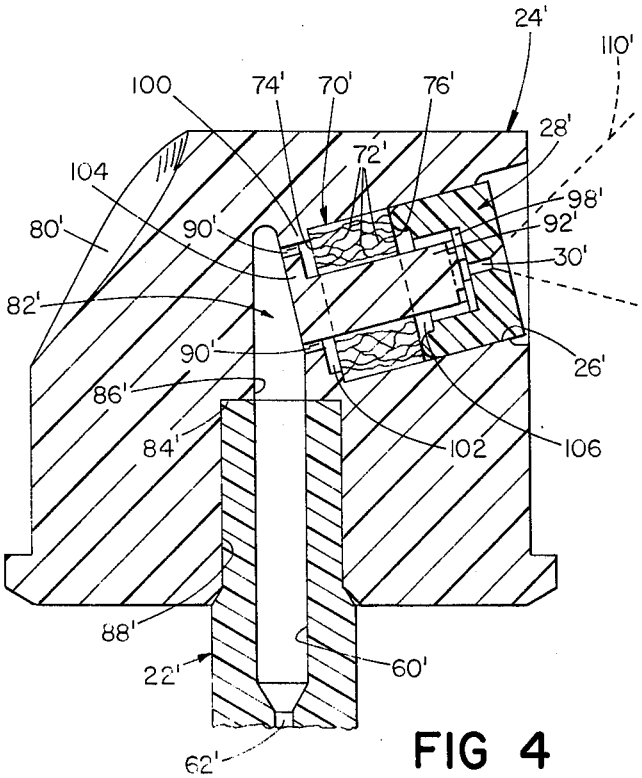
FIG. 4 is a sectional view similar to FIG. 3 showing aspects of another embodiment.

Another embodiment is shown in FIG. 4. Elements similar to those shown in FIG. 3 are identified with the addition of a prime mark to the reference numeral. Flow control member 70' is of annular configuration and is mounted on post 92' with its upstream end 74' seated on flange 100 so that a chamber 102 is provided between end 74' and cavity wall 104. A plurality of ports 90' are formed in wall 104 and provide flow communication between cavity 86 and chamber 102. Insert 28′ is seated on the downstream end 76′ of member 70′ such that a chamber 106 is provided between surface 76′ and the product breakup structure 98′ formed between the end of post 92′ and insert 28′. In an alternate construction the post structure 92′ flow control member 70′ and terminal orifice structure 28′ may be formed as a subassembly and inserted into an appropriately dimensioned recess 26′ in the button 24.

Either dispenser is operated in conventional manner by holding the container 10 in one hand and pressing button 24 or 24′ forward and downward with a forefinger or thumb, thereby rocking the stem 22, 22′ to open the valve. Product 12 held at the lower portion of the container flows into the bottom of tube 32 under the pressure of the propellant gas head 14, enters the interior of the valve housing 34 and flows through valve outlet port 62, 62′ and the discharge passage and through the breakup structure 98, 98′ for discharge in the form of a spray 110, 110′ of finely divided particles into the atmosphere through terminal port 30, 30′. The passage of the flowing product through passages 72, 72′ produce both a pressure differential across member 70, 70′ and a reduction in flow rate so that the liquid product is emitted from orifice 30, 30′ in a uniform spray pattern of finely divided particles with only a small amount of dilution (about 5%) by the gaseous propellant. Member 70, 70′ either alone or with supplemental screen 78 also functions to collect fibrous or other foreign material entrained in the product that could cause full or partial clogging of the product breakup structure 98, 98′ or terminal orifice 30, 30′ thereby preventing such foreign material from distorting the spray pattern emanating from the package. The product continues to be dispensed in a finely divided spray pattern until the cap 24, 24′ is released, at which time the valve closes to terminate the flow of product.

While particular embodiments of the invention have been shown and described, modifications thereof will be apparent to those skilled in the art. Therefore, it is not intended that the invention be limited to the disclosed embodiments or to details thereof, and departures may be made therefrom within the spirit and scope of the invention as defined in the claims.

What is claimed is:

1. A dispensing package for dispensing a liquid product such as a deodorant or a hair spray with less than ten percent propellant dilution in a finely divided and reproducible spray pattern that has substantially the same characteristics as the spray pattern of the liquid product dispensed in an aerosol system with about sixty percent propellant dilution comprising a pressurized container having therein a liquid product to be dispensed and a gaseous propellant, a valve for controlling the flow of product from the container, a discharge passage extending from said valve to a discharge orifice, said discharge orifice having a diameter in the range of 0.1–0.4 millimeter, a flow control member disposed in said discharge passage between said valve and said discharge orifice, said flow control member having multiple elongated passages and over dispensed through the discharge orifice, said product being dispensed from discrete passage apertures, the flow dimension of each elongated passage being in the range of one to one hundred microns, the total effective flow area of said elongated passages being greater than the area of said discharge orifice, and the length of at least some of said elongated passages being substantially greater than the maximum dimension of said discharge passage transverse to the product flow direction, said flow control member in dispensing action producing a pressure drop between its upstream and downstream ends as the product flows through said elongated passages, and product breakup means in said discharge passage between said flow control member and said discharge orifice for producing a turbulent flow pattern that assists the breakup of the liquid product into desirable spray form as it is dispensed through the discharge orifice, said product being dispensed from said discharge orifice in a finely divided spray pattern with less than 10 percent dilution by the gaseous propellant.

2. The dispensing package as claimed in claim 1 wherein the effective flow length of each of the passages through said flow control member is at least twice the lateral width of the discharge passage immediately downstream from said flow control member.

3. The dispensing package as claimed in claim 1 wherein said passages in said flow control member have an average flow diameter of 10 to 50 microns and an average length of at least two millimeters.

4. The dispensing package as claimed in claim 1 wherein said flow control member is a porous member of polymeric material.

5. The dispensing package as claimed in claim 1 wherein said control valve has an outlet port and said flow control member is disposed in said discharge passage adjacent said control valve outlet port.

6. The dispensing package as claimed in claim 1 wherein said flow control member is disposed in said discharge passage adjacent said orifice.

7. The dispensing package as claimed in claim 6 wherein the effective flow length of each of the passages through said flow control member is at least twice the lateral width of the discharge passage immediately downstream from said flow control member.

8. The dispensing package as claimed in claim 1 wherein said flow control member is a porous member of polymeric material, and said passages in said flow control member having an average flow diameter of 0.01–0.05 millimeter and an average length of at least two millimeters.

9. The dispensing package of claim 1 wherein said gaseous propellant is soluble in said product.

10. The package as claimed in claim 1 and further including a filter screen in said discharge passage upstream of said flow control member.

11. The package as claimed in claim 1 wherein said product has a viscosity in the range of 0.5–1500 centipoises.

12. The package as claimed in claim 11 wherein the structure defining said discharge passage includes a valve stem and an actuator button and said flow control member is located in said valve stem.

13. The package as claimed in claim 11 wherein the structure defining said discharge passage includes a valve stem and an actuator button and said flow control member is located in said actuator button.

14. The package as claimed in claim 11 wherein the length of said flow control member is at least ten times the maximum flow dimension of any one of said elongated passages.

15. The package as claimed in claim 14 wherein said product has a viscosity in the range of one to one hundred centipoises.

16. The package as claimed in claim 15 wherein said flow control member produces a reduction in flow rate of at least 10 percent.

17. A dispensing package for dispensing a liquid product such as a deodorant or a hair spray with less than 10 percent propellant dilution in a finely divided and reproducible spray pattern that has substantially the same characteristics as the spray pattern of the liquid product dispensed in an aerosol system with about 60 percent propellant dilution comprising a pressurized container having therein a liquid product to be dispensed and a gaseous propellant, a valve for controlling the flow of product from the container, a discharge passage extending from said valve to a discharge orifice, said discharge orifice having a diameter of about 0.2 millimeter, a flow control member disposed in said discharge passage adjacent said discharge orifice, said flow control member having multiple elongated passages and over 500 discrete passage apertures, the flow dimension of each elongated passage being in the range of one to one hundred microns, the total effective flow area of said elongated passages being greater than the area of said discharge orifice, and the length of at least some of said elongated passages being substantially greater than the maximum dimension of said discharge passage transverse to the product flow direction, said flow control member in dispensing action producing a pressure drop between its upstream and downstream ends as the product flows through said elongated passages, and product breakup means in said discharge passage between said flow control member and said discharge orifice for producing a turbulent flow pattern that assists the breakup of the liquid product into desirable spray form as it is dispensed from said discharge orifice in a finely divided spray pattern with less than 10 percent dilution by the gaseous propellant.

18. The dispensing package of claim 17 wherein the gage pressure of said gaseous propellant is in the range of from about 50 to about 100 pounds per square inch.

19. The dispensing package of claim 18 wherein said gaseous propellant is carbon dioxide.

20. A pressurized dispensing package for dispensing a liquid product such as a deodorant or a hair spray with less than 10 percent propellant dilution in a finely divided and reproducible spray pattern that has substantially the same characteristics as the spray pattern of the liquid product dispensed in an aerosol system with about sixty percent propellant dilution comprising:

a container having therein a liquid product to be dispensed and a pressurized gaseous propellant, a valve assembly, said valve assembly including an outlet port, and a seal controlling the flow of product from said container to said outlet port, and a discharge system in flow communication with the outlet port of said valve assembly, said discharge system including a discharge conduit, terminal orifice structure defining a single terminal orifice of about 0.2 millimeter diameter, product breakup structure adjacent said terminal orifice, and a flow control member disposed in said discharge conduit, said flow control member having multiple elongated passages and over five hundred discrete passage apertures, the flow dimension of each passage being in the range of one to one hundred microns, the total effective flow area of said passages being greater than the area of said terminal orifice, and the length of at least some of said elongated passages being substantially greater than the maximum flow dimension of any one of said elongated flow control passages, said product in traversing said discharge conduit in dispensing action undergoing a substantial pressure drop across said flow control member the material dispensed through said terminal orifice in a normal dispensing operation being at least ninety percent liquid product and said material being dispensed from said terminal orifice in a finely divided spray pattern.

21. The dispensing package as claimed in claim 20 wherein said flow control member is a porous member of polymeric material, and said passages in said flow control member have an average flow diameter of less than 0.04 millimeter and an average length of at least 2 millimeters.

22. The dispensing package as claimed in claim 20 wherein the effective flow length of each of the passages through said flow control member is at least twice the lateral width of the discharge passage immediately downstream from said flow control member.

23. The dispensing package of claim 20 wherein the gage pressure of said gaseous propellant is in the range of from about 50 to about 100 pounds per square inch.

24. The dispensing package of claim 23 wherein the gaseous propellant is soluble in said product.

25. The dispensing package of claim 24 wherein said gaseous propellant is carbon dioxide.

26. A pressurized dispensing package for dispensing a liquid product such as a deodorant or a hair spray with less than ten percent propellant dilution in a finely divided and reproducible spray pattern that has substantially the same characteristics as the spray pattern of the liquid product dispensed in an aerosol system with about sixty percent propellant dilution comprising:

a container having therein a liquid product of viscosity in the range of one to one hundred centipoises and pressurized gaseous carbon dioxide propellant, a valve assembly, said valve assembly including an outlet port, and a seal controlling the flow of product from said container to said outlet port, and a discharge system in flow communication with the outlet port of said valve assembly, said discharge system including a discharge conduit, terminal orifice structure defining a single terminal orifice of about 0.2 millimeter diameter, product breakup structure adjacent said terminal orifice, said product breakup structure defining a swirl chamber having internal surfaces that produce a swirling flow within said product breakup structure that contributes to the breakup of the liquid product as it is dispensed through said terminal orifice into the atmosphere, and a porous flow control member of polymeric material disposed in said discharge conduit between said valve and said swirl chamber, said flow control member having multiple elongated passages and over 500 discrete passage apertures, said passages in said flow control member having an average flow diameter of less than 0.04 millimeter and an average length of at least two millimeters, the total effective flow area of said passage being greater than the area of said terminal orifice, said product in traversing said discharge conduit in dispensing action undergoing a substantial pressure drop across said flow control member, and material dispensed through said terminal orifice in a normal dispensing operation being at least ninety percent liquid product and said material being dispensed from said terminal orifice in a finely divided spray pattern.

* * * * *

UNITED STATES PATENT AND TRADEMARK OFFICE

CERTIFICATE OF CORRECTION

PATENT NO. : 4,122,978

DATED : Oct. 31, 1978

INVENTOR(S) : Ronald N. Guimond et al.

It is certified that error appears in the above-identified patent and that said Letters Patent are hereby corrected as shown below:

Column 5, lines 60-1 (claim 1) "dispensed through discharge orifice, said product being dispensed from" should read --five hundred--;

Column 7, line 31 (claim 17) after "dispensed" insert --through the discharge orifice, said product being dispensed--.

Signed and Sealed this

*First* Day of *May 1979*

[SEAL]

*Attest:*

RUTH C. MASON
*Attesting Officer*

DONALD W. BANNER
*Commissioner of Patents and Trademarks*